United States Patent [19]

Faust et al.

[11] 4,141,487

[45] Feb. 27, 1979

[54] DISPOSABLE FOOD PACKAGE

[75] Inventors: Clifford C. Faust, Riverside; Mark F. Mettler, Lombard, both of Ill.

[73] Assignee: Union Carbide Corporation, New York, N.Y.

[21] Appl. No.: 782,324

[22] Filed: Mar. 29, 1977

[51] Int. Cl.[2] ..... B65D 65/10; B65D 65/38

[52] U.S. Cl. ..... 229/43; 229/87 F; 229/DIG. 14; 426/111; 426/113; 426/118; 426/395

[58] Field of Search ..... 426/111, 113, 118, 123, 426/395, 394, 403; 229/87 F, DIG. 14, 43; 220/209, DIG. 27

[56] References Cited

U.S. PATENT DOCUMENTS

| | | | |
|---|---|---|---|
| 2,361,344 | 10/1944 | Yates | 426/118 |
| 2,633,284 | 3/1953 | Moffett et al. | 426/113 |
| 2,807,550 | 9/1957 | Zarotschenzeff et al. | 426/113 |
| 2,844,475 | 7/1958 | Barnes et al. | 426/111 |
| 2,865,768 | 12/1958 | Barnes et al. | 426/111 |
| 3,052,554 | 9/1962 | Colman | 426/111 |
| 3,432,087 | 3/1969 | Costello | 426/113 |
| 3,716,180 | 2/1973 | Bemiss et al. | 426/118 |
| 3,716,369 | 2/1973 | Perlman | 426/403 |
| 3,873,735 | 3/1975 | Chalin et al. | 426/113 |
| 3,937,396 | 2/1976 | Schneider | 426/118 |

*Primary Examiner*—S. Leon Bashore
*Assistant Examiner*—William F. Smith
*Attorney, Agent, or Firm*—Eugene Lieberstein

[57] ABSTRACT

The disposable package comprises an upper layer composed of a thin film plastic material having a sealed pleated section extending from opposite parallel sides intermediate the ends thereof and an elongated vent disposed within the pleated section. The sealed pleated section is adapted to open exposing the vent at a predetermined temperature below the cooking temperature of the product.

12 Claims, 4 Drawing Figures

DISPOSABLE FOOD PACKAGE

This invention relates to a convenience food package and more particularly to a flexible package adapted to contain a food product which may be cooked within the package at elevated temperatures.

A food package designed to contain a premeasured portion of food which is to be cooked inside the package, even after relatively long intervals of storage, is not new. To satisfy the storage requirement, the food product must be sealed within the package. Many prior art designs require the package to be cooked immersed in a surrounding liquid or are otherwise limited to cooking temperatures below 212° F. At higher cooking temperatures, particularly microwave oven temperatures, instructions are generally given to open the package so as to permit release of steam or hot gas. If the package remains sealed the food product will usually suffer from the humidified cooking environment or the sealed package itself may rupture.

A more desirable package design includes an automatically operated vent or valve arrangement. Such a package must still remain sealed during storage and be capable of withstanding physical manipulation and handling without the seal opening. In addition to these requirements, the degree of venting, after reaching the temperature at which the vent is adapted to open, is important, particularly for certain food products such as bacon, where uniformity in cooking is critical. When cooking bacon, the bacon grease, formed in the package during cooking, must be evenly distributed around the bacon. The vented opening should be of a predetermined size to prevent excessive distortion of the package and should be in a predetermined location to prevent leakage. An additional requirement is the ability to remove the food product from the package and to dispose of the grease or gravy, if such is present, without spillage.

Accordingly, it is the principal object of the present invention to provide a food package which is economically simple in design having a sealed ventilated section which is adapted to automatically open upon reaching a predetermined temperature.

It is another object of the present invention to provide a food package which may be heated to a relatively high temperature and thereafter readily opened for removal of the food product without causing spillage of the liquid contents.

Further objects and advantages of the present invention will become apparent from the following detailed description when read in conjunction with the accompanying drawings of which:

Figure 1:
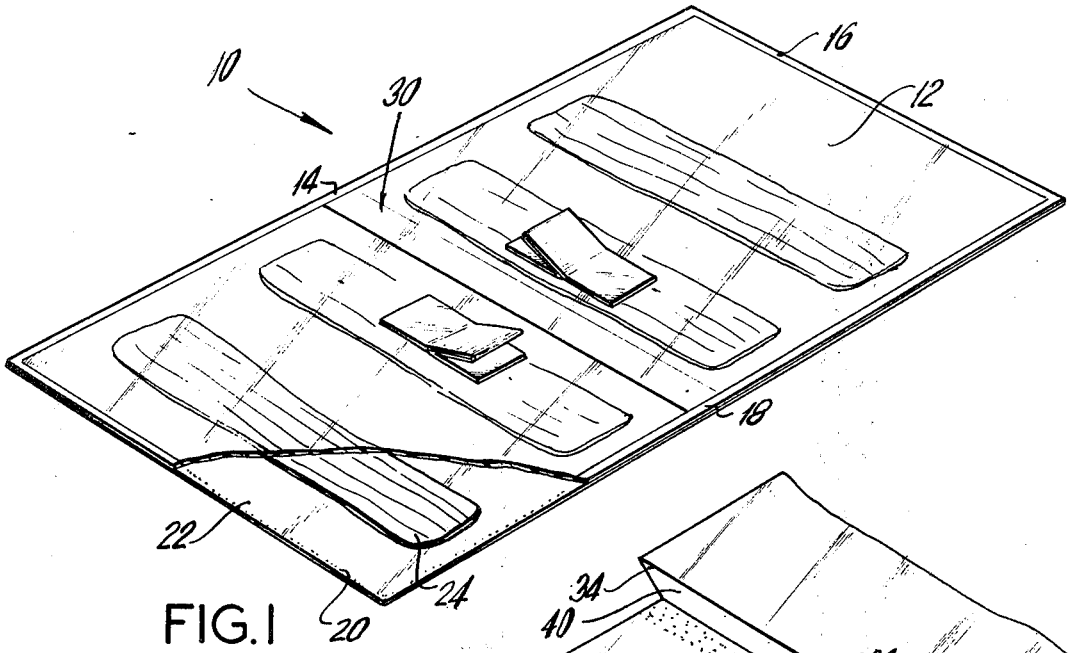
FIG. 1 is a perspective view of the sealed package of the present invention with one corner broken open to expose the interior, the bottom and the seamed edges of the package.
Figure 2:
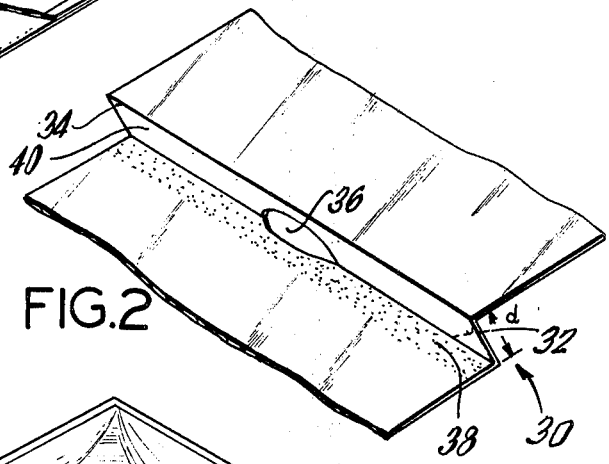
FIG. 2 is a side elevation of the top layer of the package of FIG. 1 showing the construction of the ventilated pleat.
Figure 3:
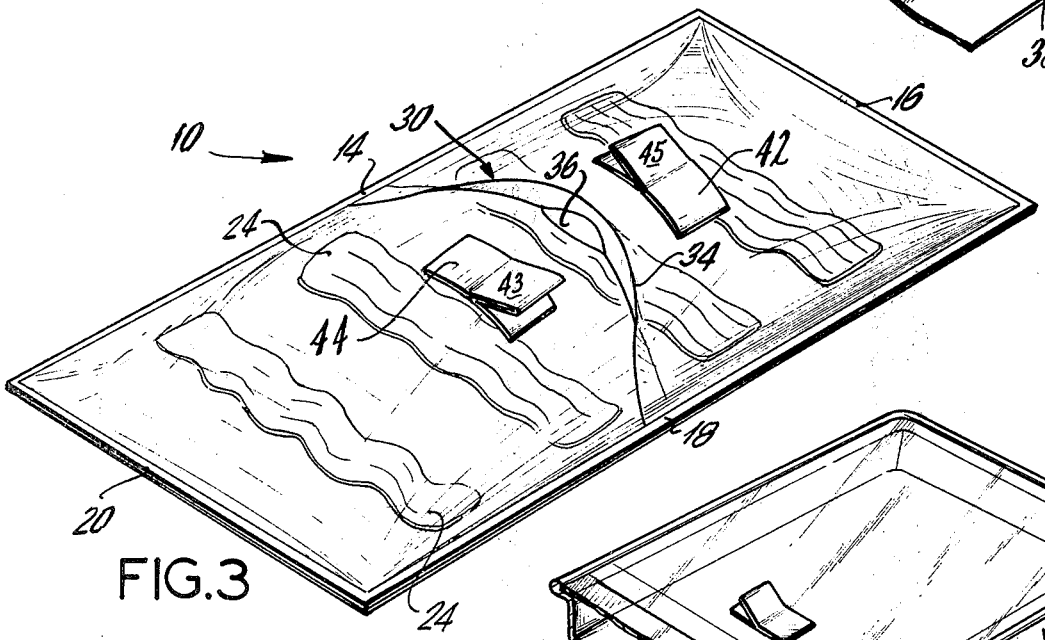
FIG. 3 is a perspective view of the package during the cooking operation with the top layer in its expanded position and the vent operational.

Referring now to FIGS. 1–3 inclusive in which the improved food package 10 of the present invention is shown comprising an upper member 12, of preferably rectangular configuration, united along its side boundaries 14, 16, 18 and 20 to a lower member 22 which preferably is of equal dimension and configuration. A food product 24 is placed upon the lower member 22 before the package 10 is sealed.

Figure 4:
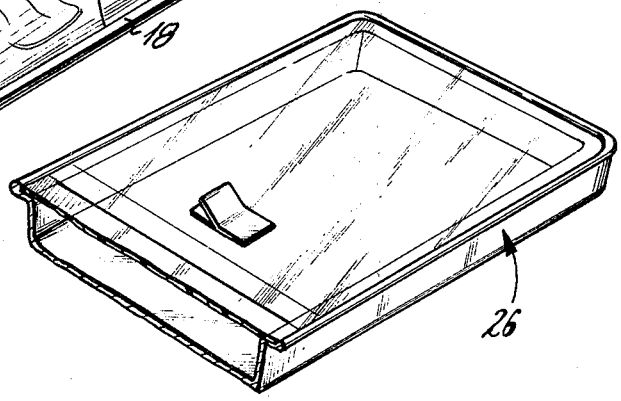
FIG. 4 is a fragmentary perspective view of an alternate embodiment of the package of FIG. 1.

The upper member 12 is preferably formed from a thin film of a clear plastic material which provides good shelf life characteristics and can withstand high cooking temperatures, particularly for cooking within a microwave oven. The preferred material is a polysulfone or a polyester film such as a polyalkylene terephthalate material particularly polyethylene terephthalate. The lower member 22 need not be of the same material composition as the upper member 12 and can, in fact, represent a conventional aluminum foil tray 26 as shown in the alternative embodiment of FIG. 4. The method used for sealing the upper member 12 to the lower member 22 at the side boundaries 14, 16, 18 and 20 respectively, will depend upon the material compositions selected for each member. Where the materials are the same or at least compatible, which is the preferred design, a conventional heat seal may be formed, using for example, a "hot-bar" as is well known in the art. Alternatively, other conventional sealing techniques may be employed such as high frequency impulse or laser welding particularly for the embodiment of FIG. 4 where an upper layer of plastic film is sealed to an aluminum tray lower member 26.

The upper member 12 includes a pleated section 30 which extends between either pair of parallel side boundaries 14 and 18, and 16 and 20 respectively, and preferably in a direction transverse to the longitudinal axis thereof. For a rectangular geometry, the preferred disposition of the pleated section 30 is in a direction transverse to the major axis and "intermediate" the two longer side boundaries, i.e., 14 and 18 respectively. "Intermediate" for purposes of the present invention is intended to encompass a distance extending from the center of the sides 14 and 18 equal to no more than about 20 percent of the side dimensions.

The pleated section 30 is preferably formed, as is more clearly evident in FIG. 2, by first folding over the upper member 12 transverse to the major axis thereof and at a desired location to form a first crease line 32. The upper member 12 is then refolded back starting from a second location to form a second crease line 34 lying a predetermined distance "d" ahead of the first crease line 32. The end view configuration of the pleated section 30 in FIG. 2 resembles the mirror image of the letter "Z".

An elongated vent opening 36 is formed along the first crease line 32 and preferably at or near the center of the member 12. The vent opening 36 may consist of at least one slit formed from the application of a knife or razor. The length of the vent opening 36 is determined by the degree of venting required for the particular food product 24 and the desired cooking temperature. Although a simple elongated slit is preferred for the vent opening 36, other aperture configurations, such as semicircles, are within the contemplation of the present invention. The invention also contemplates positioning the vent opening 36 within the pleated section 30 at a location other than along the crease line 32 provided it is located substantially at or near the center of the member 12.

A thin layer of an adhesive sealant material is applied across the surface of the upper member 12 in the form of a band 38 lying contiguous to the crease line 32. Upon folding the section 40 of the upper member 12 over the underlying sealing strip 38 the pleated section 30 is closed, sealing in the vented opening 36. This arrangement not only seals the vent 36 but protects it from an accidental opening in response to flexing and handling of the package 10. Any suitable adhesive sealant, preferably a microcyrstalline wax material, may be used having a melting point below the desired cooking temperature for the food product 24. The melting temperature for the wax is preferably in the range of 120° to 150° F. and will substantially correspond to the point in time at which venting occurs. The material must be one that is, or will be, approved by an appropriate governmental agency, such as the FDA, for at least casual contact and preferably direct contact with foodstuff. The preferred adhesive sealant is a commercially available wax sold under the name of "Paxwax" 3010, a trademark of the National Wax Company of Illinois. The pleated section 30 is preferably formed in the upper member 12 before the upper member 12 is sealed to the lower member 22 in forming the package 10.

FIG. 3 shows the upper member 12 of the package 10 distended in the operational mode with internally generated gas being exhausted through the vented opening 36. The wax seal is broken at a predetermined temperature below the cooking temperature. The vented opening should be of sufficient size to prevent the package 10 from curling up due to excessive ballooning and raising the lower member 22 off the cooking surface.

After completion of the cooking operation, the package 10 may be readily handled and lifted by gripping the tabs 42, 44 to remove the package from the cooking oven. The tabs 42, 44 are adhesively connected on opposite sides respectively of the pleated section 30 leaving an end 43, 45 extending from the surface of the upper member 12 in a direction substantially perpendicular thereto. Any high temperature plastic, paper or masking tape material may be used to form the tabs 42, 44 provided the material composition meets the government regulations for use in conjunction with, or as, a food packaging material. The preferred material for the tabs 42, 44 is a high temperature masking tape which does not retain heat such as the commercially available product sold under the tradename of "Permacel" No. 703, a product of the Johnson and Johnson Corporation of N.J. By pulling the tabs 42 and 44 the vent opening 36 can be readily enlarged to permit removal of the food contents 24. The crease line 32 may also, if desired, be scored or weakened lengthwise from the vent opening 36 to facilitate opening of the package 10 after completion of the cooking operation. The tabs 42, and 44 are positioned about the pleated section 30 near the center of the upper number 12 so as to contain the grease or other liquid residue within the package 10 during the opening of the package 10. The tabs 42 and 44 may also be used to handle the package during its disposal without suffering spillage of the grease or liquid residue. Tabs 42 and 44 may also be formed in accordance with the present invention by pleating a portion of the upper member 12.

What is claimed is:

1. A disposable package for enclosing a food product adapted to be cooked within the package at an elevated temperature without being immersed in a surrounding liquid medium comprising:

a continuous unitary layer of plastic film forming the upper wall surface of said package adapted to overlie said food product, said layer being folded over to form at least one pleated section having a cross-sectional geometry resembling the letter "Z" or mirror image thereof and having an interior fold line extending between two opposite substantially parallel sides intermediate the ends thereof;

at least one elongated opening passing through said layer and disposed along the interior fold line of said pleated section for venting gas during cooking, and an adhesive sealant material having a predetermined melting temperature below said cooking temperature, said adhesive sealant material being disposed within said pleated section for sealing said elongated opening until said predetermined temperature is reached.

2. A disposable package as defined in claim 1 wherein said layer of plastic film is a thermoplastic material formed from polyethylene terephthalate.

3. A disposable package as defined in claim 2 further comprising at least one tab located adjacent to said pleated section and having an end extending from said layer substantially perpendicular to the surface thereof.

4. A disposable package as defined in claim 3 wherein said adhesive sealant material is a medium melting point microcrystalline wax having a melting temperature within a range of from about 120° to 150° F.

5. A disposable package as defined in claim 4 wherein said film layer is rectangular and wherein said pleated section extends from opposite parallel sides in a direction substantially transverse to the major dimension thereof.

6. A disposable package as defined in claim 5 further comprising another layer of plastic film of substantially identical composition adapted to underlie the food product and having its borders attached to said overlying plastic film.

7. A disposable package as defined in claim 6 wherein said borders are adhesively bonded to said overlying plastic film.

8. A disposable package as defined in claim 6 wherein said borders are heat sealed to said overlying plastic film.

9. A disposable package as defined in claim 5 further comprising a tray adapted to underlie the food product and having its borders attached to said overlying plastic film.

10. A disposable package as defined in claim 9 wherein the borders of said tray are adhesively bonded to said overlying film.

11. A disposable package as defined in claim 9 wherein the borders of said tray are heat sealed to said overlying film.

12. A disposable package as defined in claim 9 wherein said overlying plastic film is crimped about the borders of said tray.

* * * * *